US006325655B1

(12) United States Patent
Noda et al.

(10) Patent No.: US 6,325,655 B1
(45) Date of Patent: Dec. 4, 2001

(54) ELECTRICAL CONNECTOR FOR A PGA PACKAGE

(75) Inventors: Atsuhito Noda, Hachiohji; Akinori Mizumura, Yamato, both of (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/388,846

(22) Filed: Sep. 2, 1999

(30) Foreign Application Priority Data

Sep. 4, 1998 (JP) ..... 10-267275

(51) Int. Cl.[7] ..... H01R 13/629
(52) U.S. Cl. ..... 439/342; 439/910
(58) Field of Search ..... 439/342, 259–267, 439/83, 876, 910

(56) References Cited

U.S. PATENT DOCUMENTS 4,059,323 * 11/1977 Babuka et al. ..... 439/342
4,519,660 * 5/1985 Ichimura et al. ..... 439/342
5,057,031 * 10/1991 Sinclair ..... 439/342
5,256,080 * 10/1993 Bright ..... 439/342
5,443,591 * 8/1995 Tsai ..... 439/342

* cited by examiner

*Primary Examiner*—Hien Vu
(74) *Attorney, Agent, or Firm*—Robert A. Yesukevich; Charles S. Cohen

(57) ABSTRACT

An electrical connector for a PGA package is provided for reduction of the height thereof. The electrical connector includes a base in which a plurality of terminal receiving cavities are adapted for receiving pins of the PGA package. A plurality of terminals are mounted within each of the terminal receiving cavities, and a cover is slidably mounted on the base housing. The cover includes an array of through holes adapted for insertion of the pins. The cover includes both sheet metal and insulative components.

9 Claims, 4 Drawing Sheets

ELECTRICAL CONNECTOR FOR A PGA PACKAGE

FIELD OF THE INVENTION

The present invention relates generally to an electrical connector and, more particularly, to an electrical connector for connecting a pin grid array ("PGA") package, to a printed circuit board.

BACKGROUND OF THE INVENTION

A typical PGA includes a silicon chip, a package including conductive and non-conductive components and a plurality of pins depending downward from a bottom surface of the package. Conventionally, electrical connectors for PGA's include a base housing having an array of terminal receiving cavities, a plurality of terminals mounted in the terminal receiving cavities and a cover slidably mounted on the base housing. The cover has through holes therein adapted for insertion of the pins of the PGA therethrough. In operation, the cover is initially positioned in a first or pin receiving position. The pins of the PGA are then inserted through the holes in the cover. Some type of actuator is then typically actuated in order to slide the cover and the PGA with its associated pins linearly so that the pins engage the terminals contained within the base housing. An example of a connector of this type is disclosed in Japanese Patent Publication No. 2689325.

The typical terminal of the connector of this type has a solder tail for soldering within a hole in a printed circuit board and of a contact piece for engaging a pin of the PGA. An engaging or retention portion is positioned between the solder tail and the contact piece for engaging the base housing in order to retain the terminal in the base housing.

With the typical electrical connector for the PGA package, each terminal is formed into the configuration in which the contact piece, the engaging portion and the solder tail are linear as set forth above. Therefore, the terminal length is generally long, and the thickness of the base housing is generally similar to the length of the contact piece and the engaging portion. As a result, a reduction in the height of the overall electrical connector is generally difficult without also shrinking the height of the terminal.

SUMMARY OF THE INVENTION

The present invention is intended to solve the problems set forth above. Therefore, it is an object of the present invention to provide an electrical connector for a PGA package having a structure adapted for the reduction of the height thereof.

To accomplish the above-mentioned object, the present invention contemplates the provision of a structure in which the contact piece and the engaging piece for retaining the terminal within the base housing are provided in parallel. The invention may also utilize a slidable cover formed of sheet metal with an insulative coating thereon.

A zero insertion force electrical connector for mounting on a circuit member and receiving a device having an array of conductive pin terminals is provided. The electrical connector includes a dielectric base housing with the base housing having a plurality of terminal-receiving cavities corresponding to the array of pin terminals. A cover is slidably mounted on the base housing with the cover including a metal component and an insulative component. The metal component has a plurality of through holes therein arranged in an array corresponding to the array of pin terminals for receiving the pin terminals in the through holes. The insulative component is configured to space the conductive pin terminals from the metal component of the cover upon insertion of the conductive pin terminals into the through holes. A plurality of conductive terminals are mounted in the terminal-receiving cavities of the base housing for electrically connecting the device and the circuit member. An actuating structure is provided to slide the cover along the base housing whereby at the first insertion position pin terminals inserted into the through holes in the cover are spaced from the terminals and at the second engagement position pin terminals inserted into the through holes in the cover engage the terminals to effect electrical connection between the device and the circuit member.

If desired, the insulative component of the cover may be an oxide film. If desired, the cover may include guide structure that interacts with edges of the base member to guide the cover between the first insertion position and the second engagement position. The guide structure may include openings in edges of the cover and the base housing may include projections extending from the edges of the base member into the openings in the cover. In another alternative, the array of through holes is generally rectangular and portions of the cover within the array do not include the through holes. The metal component of the cover may be generally planar. In addition, the insulative component of the cover may also be generally planar. The cover may include a generally planar layer of sheet metal and a generally planar layer of insulative material. Both the base housing and the cover may be generally planar. In addition, the cover may be movable between a first insertion position and a second engagement position. In one embodiment, the terminals are stamped and formed with each terminal including a mounting portion for securing the terminal in the base housing. A tail section is provided for contacting a conductive portion of the circuit member and a contact structure is configured for engaging a portion of a respective one of the pin terminals of a PGA upon positioning the cover in the second engagement position.

BRIEF DESCRIPTION OF THE DRAWINGS

The present invention will be understood more fully from the detailed description set forth below and from the accompanying drawings of the preferred embodiment of the present invention in which.

DESCRIPTION OF THE PREFERRED EMBODIMENTS

The present invention is discussed hereinafter in detail in terms of the preferred embodiments of the present invention with reference to the accompanying drawings. In the following description, numerous specific details are set forth in order to provide a thorough understanding of the present invention. It will be apparent, however, to those skilled in the art that the present invention may be practiced without these specific details. In some instances, well-known structures are not shown in detail in order to avoid unnecessarily obscuring the present invention.

Figure 1:
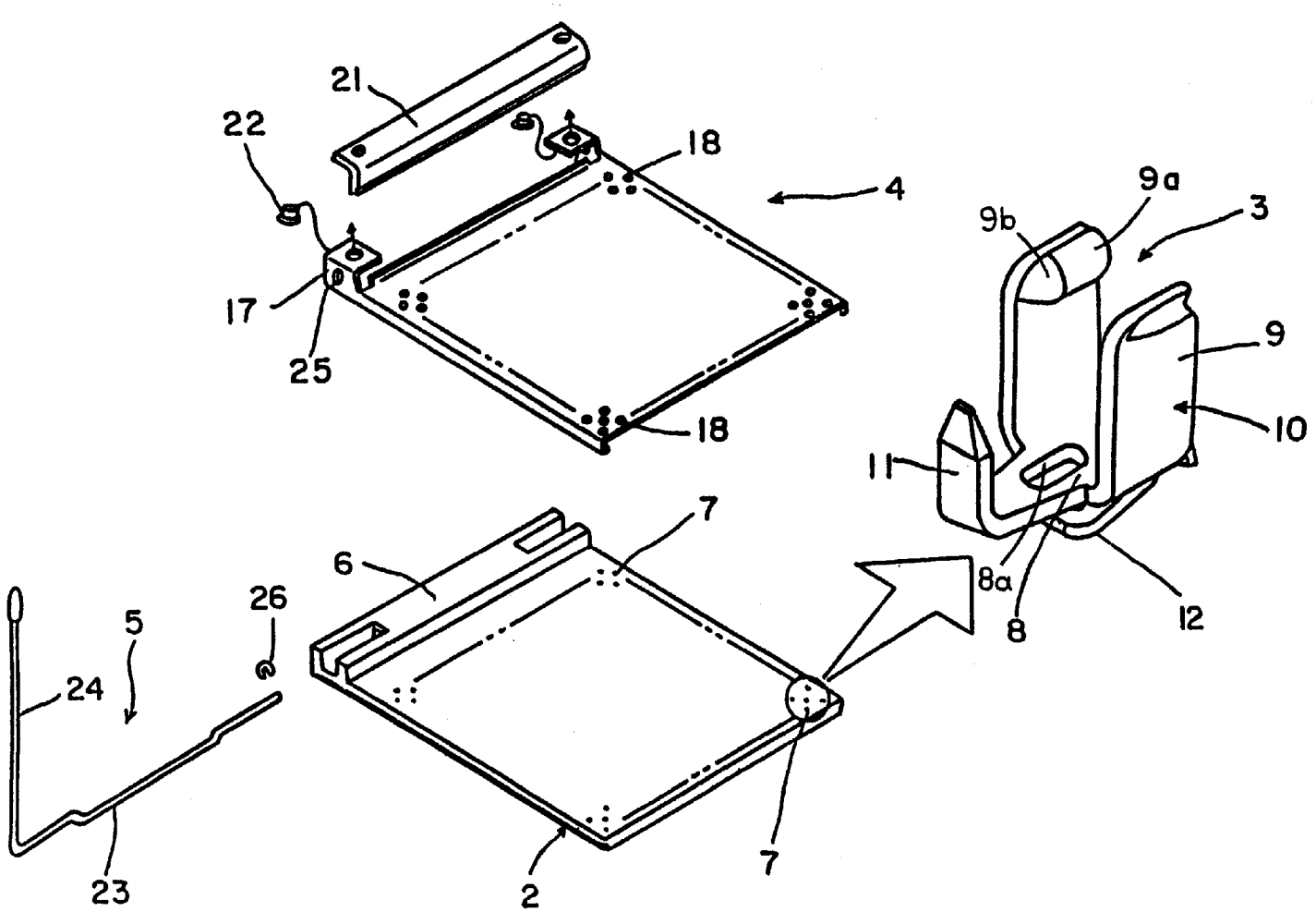
FIG. 1 is an exploded perspective view of a preferred embodiment of an electrical connector for a PGA according to the present invention with one of the terminals enlarged for clarity.

FIG. 1 is an exploded view of a preferred embodiment of an electrical connector 1 for a PGA package. A slightly different embodiment is shown assembled in FIG. 4. Referring to FIG. 1, an electrical connector 1 for receiving a PGA includes a base housing 2, a plurality of terminals 3 mounted in terminal receiving cavities 7 in the base housing 2, and a slidable cover 4 mounted on the upper side of the base housing.

Figure 2:
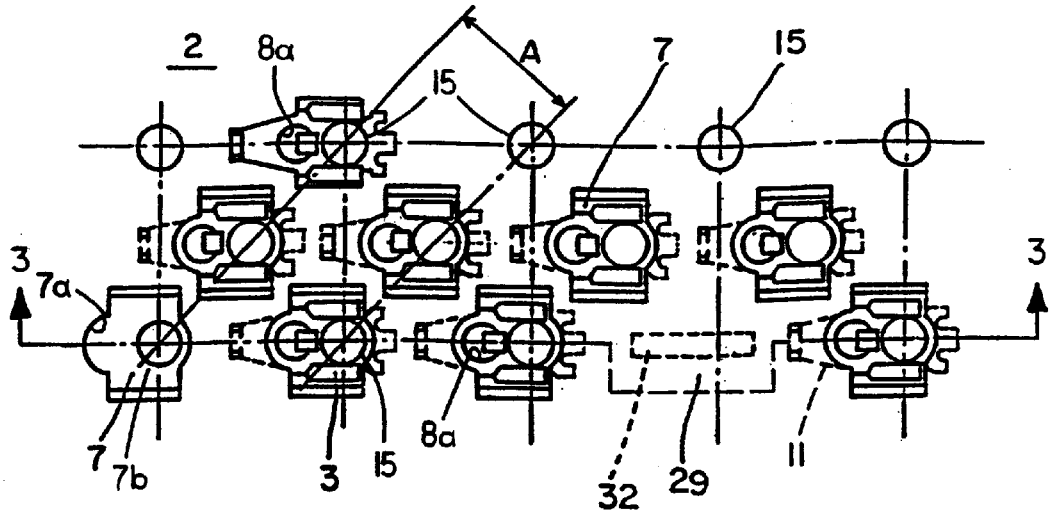
FIG. 2 is an enlarged fragmented top plan view of the preferred embodiment of the base housing and terminals according to the present invention with certain terminals removed for clarity.

The base housing 2 is molded of dielectric plastic as a thin, generally rectangular plate. One end includes a mounting portion 6 for receiving an actuating lever 5 that drives the cover 4 back and forth in a linear fashion. Terminal receiving cavities 7 are formed in a grid array fashion over generally the entire area of the base housing 2 other than mounting portion 6 and as otherwise described below. The terminal receiving cavities 7 formed in grid array fashion are offset one half pitch in adjacent rows in both longitudinal and transverse directions as shown in FIG. 2. In other words, the cavities are located in a staggered fashion as a whole. By this arrangement, it becomes possible to make the distance "A" along diagonal rows of terminals indicated in FIG. 2 as short as possible (for example, 1.27 mm).

A conductive terminal 3 is mounted within each terminal receiving cavity 7. As best shown in FIG. 1, each terminal 3 is stamped and formed of sheet metal, and includes a generally U-shaped spring contact 10 formed of a base piece 8 and a pair of contact arms 9 extending up from the base piece. A terminal retention piece 11 also extends upwardly from the base piece generally in parallel with the contact arms 9 for engaging a recess 14 in the lower surface 2*a* of base housing 2 in an interference fit in order to retain the terminal in the housing. The distal end of each contact arm 9 is inwardly bulged to form a contact portion 9*a* that engages a pin 15 of a PGA. Furthermore, a solder tail 12 extends from an edge of the base piece 8 opposite retention piece 11. The solder tail extends initially away from base piece 8 and then curves downward until it angles downward relative to the lower surface 2*a* of the base housing 2 in a generally linear manner to provide an appropriate tail for surface mount soldering on the surface of a printed circuit board 13. An end portion of the solder tail may extend upwards. An opening 8*a* (elliptical in FIG. 1 and round in FIGS. 5 and 6) is provided in base piece 8 in order to permit inspection of the solder 2 tail 12 from above once the base housing 2 and terminals 3 are soldered to printed circuit board 13 but before the cover 4 is mounted to the base housing.

In lower surface 2*a* of the housing board 2, recesses 14 are formed adjacent to the cavities 7 for receiving the terminal retention pieces 11. Each terminal 3 is mounted from the bottom of base housing 2 through bottom surface 2*a*, and fixed in the base housing by an interference fit between the retention piece 11 and the recess 14. The cavities 7 are formed with a first insertion section or space 7*a* at which a pin 15 of a PGA may be inserted with zero insertion force and a second engagement section or space 7*b* which receives contact arms 9 of terminal 3.

Figure 4:
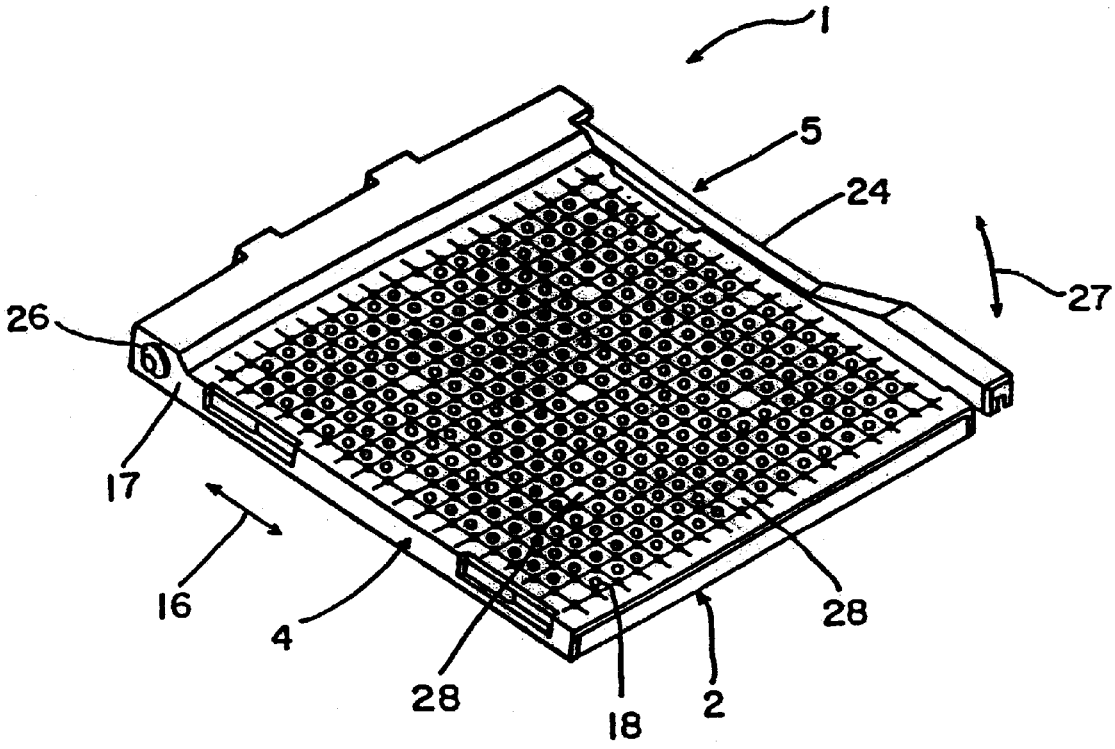
FIG. 4 is a perspective view a second embodiment of the electrical connector according to the present invention.

The cover 4 is formed in a generally rectangular plate configuration having a size generally similar to that of the base housing 2 as shown in the drawings. In the preferred embodiment, the cover 4 is formed of metal sheet (aluminum, stainless steel or the like). The cover 4 may be formed with the side edge portions 4*a* formed into a channel shaped configuration in cross section as shown in FIG. 1 or with the side edge portions 4*b* formed into an L-shaped configuration in cross section as shown in FIG. 4 for engaging with the side edge of the base housing 2. As such, the side edge portions are adapted to guide the cover 4 as it slides in the direction of arrow 16 (FIG. 4) by operating the lever 5.

Figure 3:
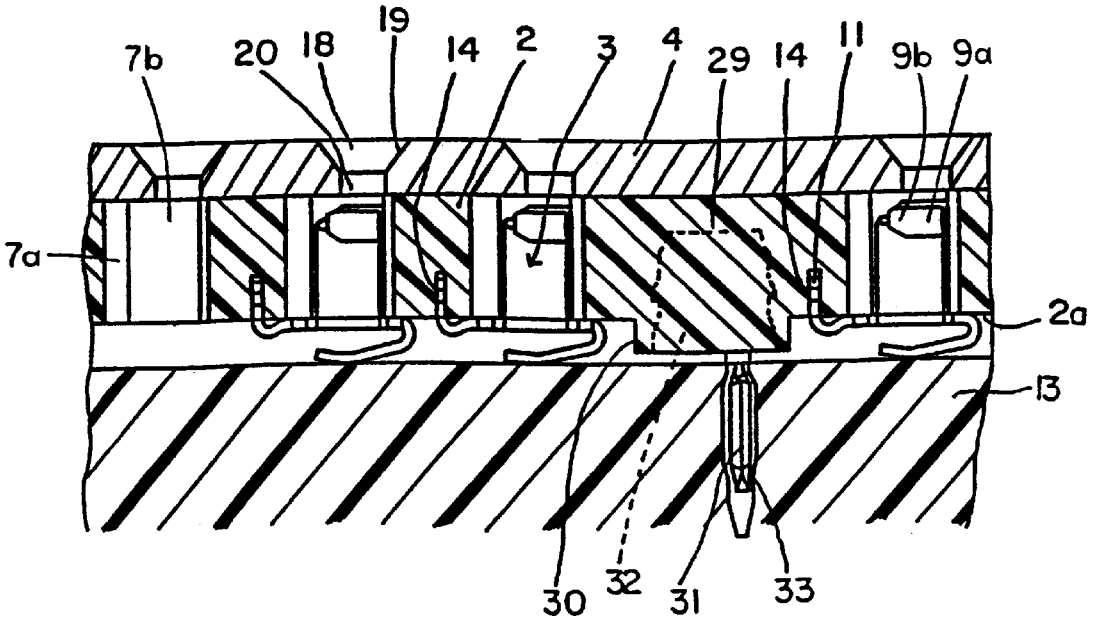
FIG. 3 is a partially enlarged section generally along line 3—3 of FIG. 2 showing the electrical connector of FIG. 1 mounted on a printed circuit board with the cover positioned in the engagement position.

Substantially, the entire area of the cover 4 has through holes 18 provided in a grid array fashion corresponding to the terminal receiving cavities 7 of the base housing 2. The through holes 18 are adapted for insertion of the pins 15 of the PGA and, as best seen in FIG. 3, include counter bores or tapered sections 19 on the top surface of cover 4 and straight holes 20 extending from the counter bores 19 to the lower surface of the cover. The rear edge portion 17 of the cover 4 may be constructed with a stiffener 21 mounted with rivets 22 as shown in FIG. 1. In the alternative, the cover may be formed as a one-piece structure as shown in FIG. 4. The cover 4 formed of metal sheet is coated by an insulating coating or material such as an oxide film or the like to prevent it from electrically conducting with the pins 15 inserted into the through holes 18.

As shown in FIG. 1, an L-shaped actuating lever 5 includes crank bar or cam portion 23 and operating lever portion 24. The center section of the crank bar portion 23 is inserted into the mounting portion 6 of the base housing 2, and opposite end portions thereof are inserted into holes 25 formed in the rear edge portion 17 of the cover 4. Snap rings 26 are mounted onto ends of crank bar portion 23 in order to secure the lever in the connector 1. By rotating the operating lever portion 24 of the lever 5 as indicated by arrow 27 of FIG. 4, the cover 4 slides back and forth as indicated by arrow 16. This sliding movement is consistent with the orientation of the rows of the terminal receiving cavities 7 and the terminals 3. The lever 5 rotates between an insertion position in which the operating lever portion 24 is vertical (as shown in FIG. 1) and an engagement position in which the operating lever portion 24 is horizontal (as shown in FIG. 4).

As set forth above, a plurality of the through holes 18 are formed in the cover 4 in a grid array fashion. However, there are some blank locations 28 in which through holes are not formed in the grid on the cover. In addition, there are some blank locations 29 on base housing 2 in which no terminal receiving cavities are formed. The blank locations 28 on cover 4 correspond to the blank locations 29 on base housing 2. A projection 30 extends from the bottom surface 2*a* of base housing 2 at a location aligned with each blank location 29 as shown in FIGS. 2 and 3. A compliant pin 31 includes a press-fit retention section 32 that is secured within a recess in each projection 30 on the bottom surface 2*a*.

FIG. 3 shows the preferred embodiment of the electrical connector 1 mounted on printed circuit board 13. Each compliant pin 31 projecting from the bottom surface 2*a* of the base housing 2 is engaged with an engaging hole 33 in the printed circuit board 13. In conjunction therewith, the solder tails 12 of the terminals 3 that are arranged in a staggered fashion along the bottom surface 2*a* of the base housing 2 are positioned to be surface mount soldered to circuit pads (not shown) on the printed circuit board 13.

Figure 5:
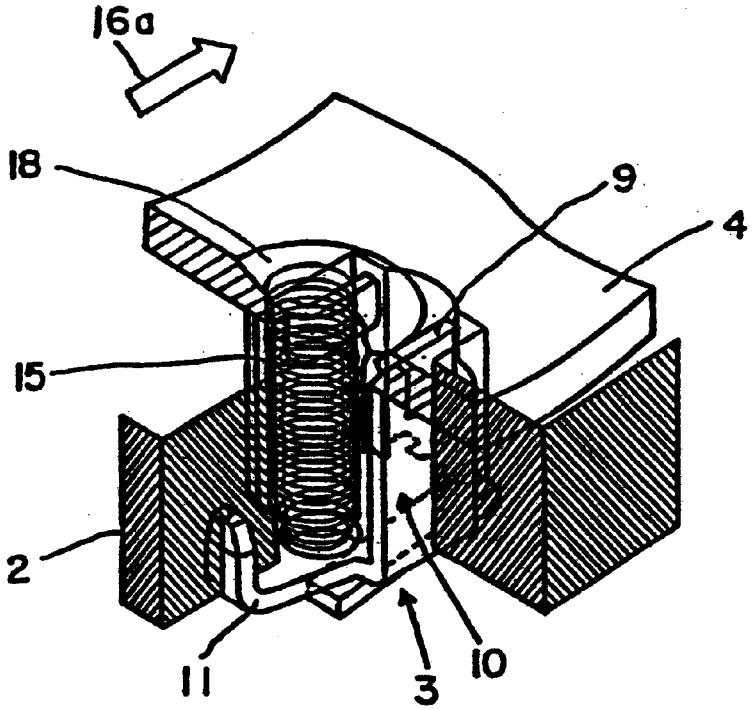
FIG. 5 is a fragmented perspective view showing the position of the cover relative to the base housing and a terminal with the cover in the insertion position.
Figure 6:
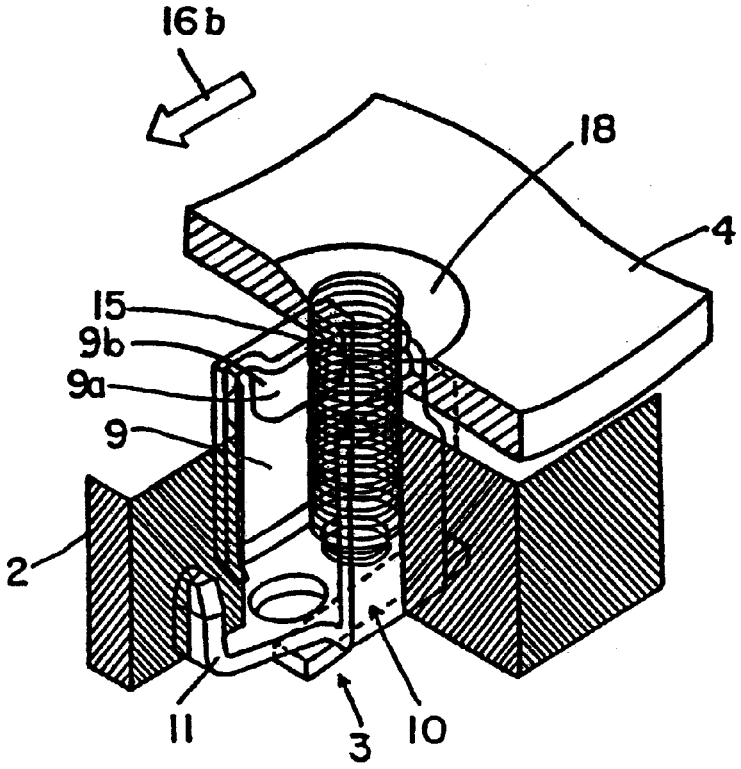
FIG. 6 is a fragmented perspective view showing the position of the cover relative to the base housing and a terminal with the cover in the engagement position.

FIGS. 5 and 6 illustrate the position of the cover 4 relative to the base housing 2 and the terminals 3 in the insertion and engagement positions of the operating portion 24 of the lever 5. Namely, FIG. 5 is an illustration showing the condition in the insertion position of the operating portion 24. It can be seen that the through hole 18 in cover 4 is aligned with insertion section 7*a* so that pin 15 of the PGA may be inserted into through hole 18 without engaging contact arms 9 of terminal 3. This permits the insertion of the PGA into the connector 1 with essentially zero insertion force.

By rotating operating lever 24 towards its engagement position, the cover 4 can be slidingly moved as indicated by arrow 16*a* to the position where the through hole 18 of the cover 4 is aligned with the spring contact 10 of the terminal 3. FIG. 6 shows this condition in which the operating portion 24 of lever 5 is in the engagement position. At such engagement position, the through holes 18 in the cover 4 are aligned with the contact arms 9 of terminals 3. As the cover slides from the insertion position (FIG. 5) to the engagement position (FIG. 6), the pins located within the through holes 18 slide over ramps 9*b* of terminal 3 while deflecting the contact arms 9. Ultimately, the pins are positioned between and engage contact portions 9*a* of the terminal 3. Upon rotating the operating lever 24 from the engagement position toward the insertion position, the cover 4 slides as indicated by arrow 16*b* to move the through hole 18 with the pin 15 therein to the insertion section 7*a* of the terminal receiving cavity 7 in order to permit the PGA to be removed from the connector 1.

When the PGA is connected to the printed circuit board 13 via the electrical connector 1, the PGA is placed on the cover 4 after the operating portion 24 of the lever 5 is in the insertion position, and the pins 15 are inserted into the insertion section 7*a* of the contact holes 7 via the through holes 18 of the cover 4. Each pin 15 is generally positioned between the spring contact 10 of each terminal 3 and the terminal retention piece 11.

When the operating portion 24 of the lever 5 is moved to the engagement position, the cover 4 and PGA mounted thereon slides in the direction of arrow 16*a* of FIG. 5. Accordingly, the pins 15 and the overall PGA slide in the identical direction so that each pin 15 is moved into engagement with the spring contact 10 of its corresponding terminal 3. As a result, the pins 15 are engaged with the contact portions 9*a* of the contact arms 9 and placed into the condition where they are connected with the circuits of the printed circuit board 13 via the terminals 3.

Each terminal 3 is configured whereby the spring contact 10 and terminal rotation piece 11 are generally in parallel. Therefore, the contact arms 9 can achieve the desired spring characteristics by having an effective spring length generally similar to the thickness of the base housing 2. By removing the terminal retention section 11 from the electrical path and by providing redundant contact arms 9, improved electrical characteristics are provided.

Since the overall length of the effective spring length of the contact arms 9 can be made generally similar to the thickness of the base housing 2, the length of the contact arms 9 and the thickness of the base housing 2 can be reduced as long as spring performance necessary for the desired electrical conduction can be provided. Therefore, reduction of the height of the electrical connector 1 can be achieved. Furthermore, by shortening the length of the contact arms 9 and by providing redundant parallel electrical paths, the inductance of the terminals 3 can be reduced which improves the connector's ability to transmit high speed signals. It should be noted that forming the cover 4 of metal sheet also contributes to a reduction of height or thickness of the electrical connector 1 since the cover 4 can provide the necessary strength even though it is extremely thin.

When the pins 15 of the package are moved into contact with the spring contacts 10 of the terminals 3 upon operation of the lever 5 as set forth above, stress is exerted in the sliding direction relative to the terminals 3 and the base housing 2. The compliant pins 31 engaged with the printed circuit board 13 to resist this stress. Accordingly, excessive stress on the soldering portions of the solder tails 12 of the terminals 3 is avoided which can cause an incomplete connection due to peeling off of the soldering tails 12 from the pads on the circuit board 13.

Upon rotating lever 5 to the insertion position, the pins 15 of the PGA are moved away from engagement with the spring contacts 10 as indicated by arrow 16*b* in FIG. 6 to permit removal of the PGA from connector 1 without necessitating a large withdrawal force. Again, the compliant pins 31 can protect the soldering portions of the solder tails 12.

Although the foregoing preferred embodiment shows the contact piece 10 of each terminal 3 having a generally U-shaped configuration with the base piece 8 and a pair of the contact arms 9, one arm could be removed so that the contact piece is not generally U-shaped but rather L-shaped.

Furthermore, the form of the solder tail 12 of each terminal 3 is also not limited to the configuration adapted for surface mount soldering. The solder tails may be formed as pins that extend into through holes in the printed circuit board 13 and soldered by wave soldering.

Although the present invention has been illustrated and described with respect to exemplary embodiment thereof, it should be understood by those skilled in the art that the foregoing and various other changes, omissions and additions may be made therein and thereto without departing from the spirit and scope of the present invention as set forth in the appended claims.

What is claimed is:

1. A zero insertion force electrical connector for mounting on a circuit member and receiving a device having an array of conductive pin terminals, said electrical connector comprising:

a dielectric generally planar base housing, said base housing having a plurality of terminal-receiving cavities corresponding to the array of pin terminals;

a generally planar cover slidably mounted on said base housing, said cover being movable between a first insertion position and a second engagement position, said cover having a plurality of through holes therein arranged in an array corresponding to the array of pin terminals for receiving said pin terminals in said through holes, said cover formed of a generally planar metal sheet coated with an insulative metal oxide film, said metal oxide film being configured to prevent said conductive pin terminals from engaging said metal sheet of said cover upon insertion of said conductive pin terminals into said through holes;

a plurality of stamped and formed conductive terminals, one of said terminals being mounted in each of said cavities, each said terminal including a base having two ends, a terminal retention piece extending from one end of said base for securing said terminal in said base housing, a tail section extending from the other end of said base for contacting a conductive portion of said circuit member and a contact structure configured for engaging a portion of a respective one of said pin terminals; and an actuating structure to slide the cover along said base housing between said first insertion position at which said pin terminals inserted into said through holes in said cover are spaced from said terminals and said second engagement position at which said pin terminals inserted into said through holes in said cover engage said contact structures of said terminals to effect electrical connection between said pin terminals and said circuit member.

2. The electrical connector of claim 1 wherein said array of through holes is generally rectangular.

3. The electrical connector of claim 1 wherein said cover includes side edge portions which interact with edges of the base member to guide said cover between said first insertion position and said second engagement position.

4. The electrical connector of claim 3 wherein said side edge portions are of channel shaped cross section.

5. The electrical connector of claim 3 wherein said side edge portions are of L-shaped cross section.

6. A zero insertion force electrical connector for mounting on a circuit member and receiving a device having an array of conductive pin terminals, said electrical connector comprising:

a dielectric base housing, said base housing having a plurality of terminal-receiving cavities corresponding to the array of pin terminals;

a cover slidably mounted on said base housing, said cover including side edge portions of L-shaped cross section which interact with edges of the base member to guide said cover between a first insertion position and a second engagement position, said cover formed of a generally planar metal sheet coated with an insulative metal oxide film, said metal sheet having a plurality of through holes therein arranged in an array corresponding to the array of pin terminals for receiving said pin terminals in said through holes, said metal oxide film being configured to space said conductive pin terminals from said metal sheet of said cover upon insertion of said conductive pin terminals into said through holes; and a plurality of conductive terminals mounted in the terminal-receiving cavities of said base housing for electrically connecting said device and said circuit member.

7. The electrical connector of claim 6 further including an actuating structure to slide the cover along said base housing whereby at said first insertion position pin terminals inserted into said through holes in said cover are spaced from said terminals and at said second engagement position said pin terminals inserted into said through holes in said cover engage said terminals to effect electrical connection between said device and said circuit member.

8. The electrical connector of claim 6 wherein said cover is movable between a first insertion position and a second engagement position.

9. The electrical connector of claim 6 wherein said terminals are stamped and formed with each said terminal including a mounting portion for securing said terminal in said base housing, a tail section for contacting a conductive portion of said circuit member and a contact structure configured for engaging a portion of a respective one of said pin terminals upon positioning said cover in said second engagement position.

* * * * *